United States Patent [19]

Riskin

[11] Patent Number: 4,555,618

[45] Date of Patent: Nov. 26, 1985

[54] METHOD AND MEANS FOR COLLECTING HIGHWAY TOLLS

[75] Inventor: Bernard N. Riskin, Lambertville, N.J.

[73] Assignee: R L Associates, Yardley, Pa.

[21] Appl. No.: 500,584

[22] Filed: Jun. 2, 1983

[51] Int. Cl.[4] ..... G07B 15/02

[52] U.S. Cl. ..... 235/384; 235/472

[58] Field of Search ..... 235/384

[56] References Cited

U.S. PATENT DOCUMENTS 3,705,976 12/1972 Platzman ..... 235/384

4,303,904 12/1981 Chasek ..... 235/384

OTHER PUBLICATIONS

*Engineering News Record,* "To Pay Interstate . . . ", Jun. 30, 1960, pp. 38, 39.

*Primary Examiner*—Harold I. Pitts

*Attorney, Agent, or Firm*—Sperry, Zoda & Kane

[57] ABSTRACT

A system especially adapted for facilitating the collection of tolls on highways, includes the provision of exteriorly visible bar codes or other machine-readable customer account identifications, on vehicles using toll roads. Issuance of the account identification elements enables the customer to pass assigned scanning locations where the elements are machine-read, and verified at a computerized station serving a selected number of scanning locations. Through a computerized network, the scanned data is ultimately transmitted to credit-issuing companies, for billing to the customers who have used the machine-readable elements. The system permits a vehicle to continue past the scan point without stopping, thus offering maximum convenience to motorists, speeding up the flow of traffic, and reducing the number of personnel required at highway toll plazas.

19 Claims, 2 Drawing Figures

METHOD AND MEANS FOR COLLECTING HIGHWAY TOLLS

BACKGROUND OF THE INVENTION

In the face of ever-increasing traffic loads on heavily traveled toll roads, the supervisory highway authorities have been hard put to maintain a smooth flow of traffic, particularly in areas of maximum congestion such as toll plazas. Here, it is customary to require a substantial number of personnel, this being true even with an increasing use of "exact change" lanes. The inconvenience to travelers is substantial, quite apart from the expense incurred by the authorities in issuing tickets and/or collecting tolls from motorists as they enter and leave the toll road, or pass given toll collection points located along the length of the highway.

In its broader sense, the present invention is a method of and a means for permitting tolls to be automatically charged on toll roads, toll bridges, toll tunnels, and other areas which require the collection of a fee for vehicle use therein. In a more specific sense, the invention is a method of automatically charging tolls in the required amount, without requiring stoppage of a vehicle as it passes a given charge point, and a computerized system for implementing this desirable aim.

It is known, in the prior art, to permit one to be automatically charged with a toll as his vehicle passes a given point on a highway or other area, the use of which requires payment of a toll or similar fee. However, deficiencies in the prior art arrangement have been noted. For example, it has been proposed to equip vehicles with transponders operative upon sensors mounted in the road (British Pat. No. 1,219,123) in association with a pulse counter pre-set according to the amount of an advance deposit account established by the motorist.

It has also been proposed, in U.S. Pat. No. 4,160,522, to mount a scanning device adapted to read bar codes on freight cars, with a view to maintaining up-to-date information as to the location of the cars.

It is, of course, also known to provide cameras at toll plazas, which will photograph the license plates of vehicles that pass through the plazas without paying tolls.

All of these methods of identifying vehicles as they pass given points, and in some instances establishing the amounts of the tolls required for vehicle use, have nevertheless failed to accomplish certain very important objects.

For example, the widespread use of credit cards, and the proliferation of so-called "credit card companies" issuing cards that can be used to make purchases of an almost limitless variety, clearly makes it desirable to offer a credit-type toll system that will permit one to automatically and with maximum convenience, charge tolls in the proper amounts, and be billed by the credit grantor on a regular monthly statement.

Another important object of the present invention, designed to overcome the deficiencies of the prior art systems, is to not only automatically charge a toll against a vehicle passing a given toll charge point, but also transmit the account identification made at that point, through a computer system in which, fully automatically, the identification will ultimately be transmitted to the billing authority of the particular grantor of the credit card used by the motorist, and will be automatically billed as part of the regular, periodic billings addressed to the customer for purchases made on the credit extended by the grantor.

Another object of the present invention, intended to overcome the deficiencies in the prior art systems, is to offer a system which will speed up the flow of traffic through toll plazas, where traffic often becomes choked during periods of heavy use of the facility, often creating long traffic jams with consequent irritation and very importantly, a great waste of fuel.

Another object of importance is to provide appreciable reductions in the normal expenses required by highway or tunnel toll authorities in the maintenance of toll booths. Even with "exact change" lanes, the present system requires that toll plazas be staffed with a large number of employees, thus making it obviously desirable that a fully automatic system for extending credit to motorists be provided, in which the toll will be charged automatically and without requiring the present of employees of the toll-levying authority.

Another important object, especially for business users, is to automatically provide, for the motorist, a receipt and permanent record of the transaction to facilitate charging of the toll as a business expense. To this end, the invention is so designed as to provide automatic recordation of tolls charged on credit, not only for individual motorists, but also for the operators of fleets of trucks, limousines, or other business vehicles. Fleet operators are enabled, in accordance with the invention, to have a complete record of the exact times and amounts of recorded tolls. They are thus provided not only with an automatic and accurate record of the toll incurred by operation of the vehicles in the fleet, but also are given the capability of monitoring driving times of their vehicle operators, for example. Utilizing the system comprising the present invention also permits fleet operators to maintain accurate records relating to other aspects of vehicle fleet operation, including the number of trips taken by individual vehicles, vehicle location on the highway system, and exact toll recording times.

Another object is to provide further advantages to vehicle drivers or owners, for example elimination of the requirement for stopping of a vehicle to pay a toll, and passage of a vehicle through a toll station at close to a normal driving speed.

Another object is to provide advantages to a vehicle owner or driver, by eliminating or minimizing congestion at toll plazas, and to increase economical fuel usage by minimizing stop-and-go driving.

Still another object is to promote driver convenience by eliminating the necessity of one's endeavoring to locate coins or bills to pay tolls on approaching toll plazas.

Another object is to provide advantages for the authority operating the turnpike, bridge, tunnel or the like, and responsible for collecting the tolls, by not only reducing the number of toll booth operators as discussed above, but also, reducing the total amount of cash handled and in this way promote better security.

Another object is to provide, for a vehicle owner or driver, a complete record usable in justification of business travel expenses, for such purposes as supporting tax returns and obtaining reimbursement for the expenses incurred.

Another object is to facilitate the calculation and granting of "commuter discounts", e.g., monthly rates and the like.

Another object is to provide further advantages for a toll road authority, by smoothing traffic flow and permitting vehicles to proceed through the toll station at close to normal highway speeds.

Yet another object is to provide an advantage for a toll road authority or the like, in that funds will be transferred to the authority directly to the bank used by them, through electronic fund transfer on a regular basis.

It is also an object to promote advantages to the credit-extending and billing authorities, by increasing their total billing volume.

Another object is to reduce the amount of cash flow through the toll system, so that the cash that must be counted and picked up at toll plazas, or elsewhere in the system, and transported in armored vehicles, can be greatly reduced.

SUMMARY OF THE INVENTION

Summarized briefly, the present invention comprises a method of and a means for automatically extending credit to, and thereafter billing, customers of credit grantors, for example nationally known credit card companies. To this end, the invention contemplates the installation, at a toll booth plaza, of machines of the type adapted to read account identification cards or similar elements. In accordance with the invention, it is proposed to provide, in the preferred embodiment of the invention, bar code decals, stickers, or the like, mounted upon a window or other suitable location on a vehicle, and representing the specific account identification assigned to the customer of a credit card company. The position of the coded element on the vehicle permits it to be read by the machine at the toll booth plaza, as the vehicle passes the machine, even at close to highway speeds.

In accordance with the invention, the data recorded by the machine is automatically transmitted to the computer of a station serving a specified grouping of vehicle-scanning locations. Here, verification of the validity of the account is provided. If credit has been denied, and the vehicle is still within the control of the system, appropriate action may be taken to block its exit. For example, on turnpikes on which there is an appreciable time lapse between entry and exit, the verification process can be completed before an attempt to exit the turnpike can be attempted. This could if desired permit physical blocking of the exit attempt. Or, perhaps, a small computer located at the entry gate can be programmed to check only a relatively small "bad list" of numbers and this can be checked rapidly enough to deny the driver passage beyond the entry gate. Also, habitual offenders using the same check point regularly can be observed and apprehended.

From the station, the information is input to a central computer receiving information from similar stations throughout the jurisdiction of the toll-collecting authority. From this location, the central computer transmits automatically, to a central collection point, full data as to individual toll charges, times, locations, and account identification. The collection point for data transmitted by the central computer receives similar information from toll highway authorities or the like throughout the country, and separates the information in its own computer for transmission, automatically, to the individual credit card companies involved, where the information is fed into their computers and automatically billed to their credit card customers.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1:
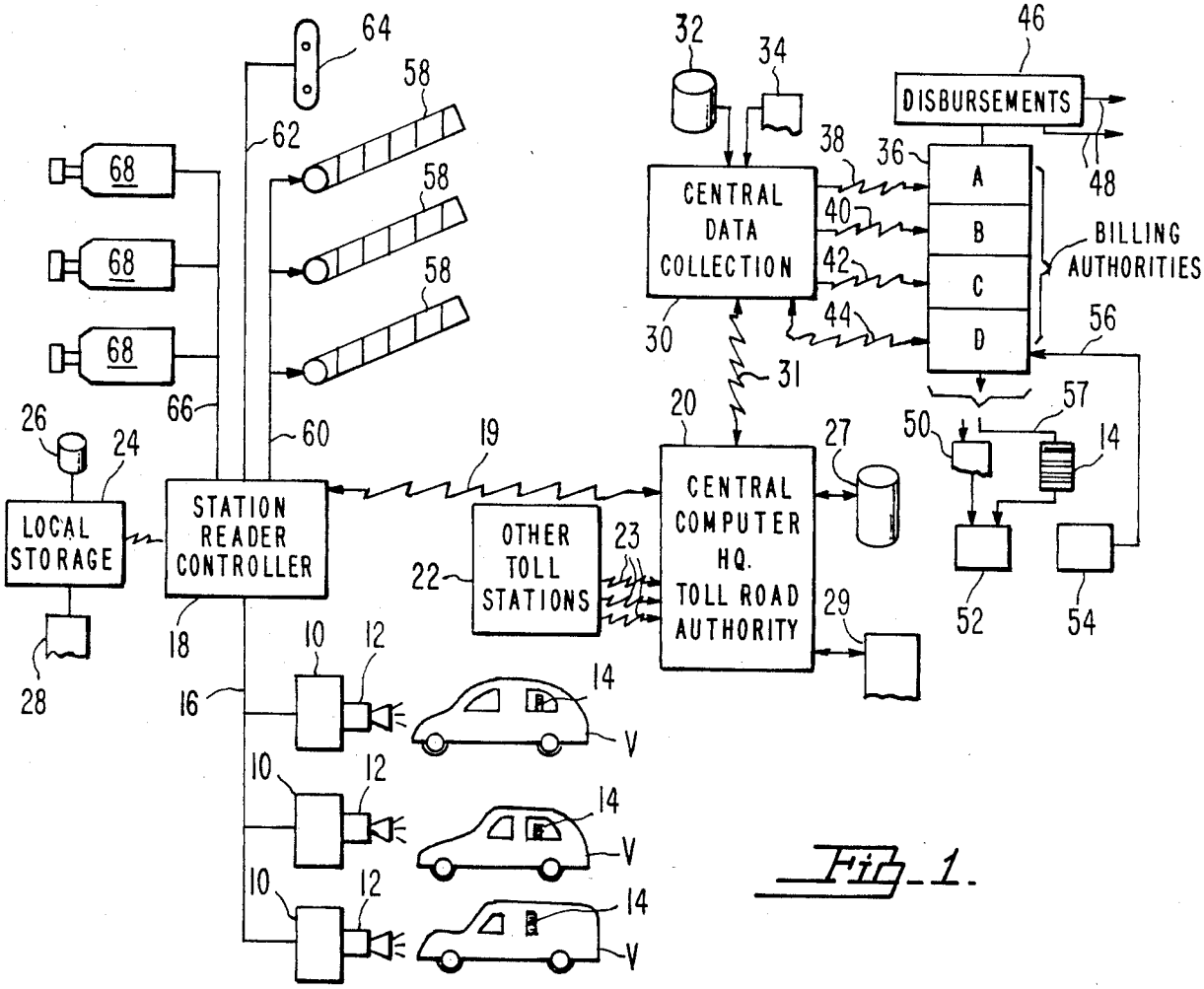
FIG. 1 is a schematic representation of a credit-extending and billing system for vehicle use, according to the present invention.

Referring to the drawing in detail, in order to facilitate an understanding of the invention and the components of the system embodied therein, it is appropriate to provide certain definitions of terms used herein.

As used herein, "account identification" means a bar code, or a numeric, alphanumeric or alphabetic series, or any other readable intelligence or indicia identifying a particular customer of a credit grantor from all other customers of that or other grantors.

The term "scanning locations" means highway toll booths, parking area exits, or any point where movement of the vehicle past it means that the vehicle will incur, or has incurred, a charge for such passage.

The term "credit grantor" means credit card companies, banks, governmental or quasi-governmental authorities, that extend credit permitting customers to charge purchases made from subscribing businesses.

The term "data" means, broadly, information as to a credit customer, whether a business or an individual person to whom credit has been extended, the customer's billing address, credit limits, account identification, the amount of the toll or other vehicular expense that has been charged, and the date, time, and place where the charge was incurred, together with any other information found necessary or desirable by the toll collection authority or the credit grantor.

In the drawing, the reference numeral 10 has been applied to toll stations or booths, each of which, as is well known, is located in controlling relation to traffic passing through an adjacent lane of a toll plaza of a road, highway, bridge, or other area where tolls are levied by a supervisory authority.

In accordance with the invention, there are mounted, at the individual stations, scanning machines 12, individual to the respective lanes and disposed in position to read account identification elements 14 carried by vehicles V passing through the lanes. The elements 14, in a preferred embodiment, are stickers or decals containing bar codes, similar to those commonly applied to food items sold in supermarkets. Preferably, the element is applied to the car in such a fashion as to be non-removable unless destroyed in the process of removal. The bar code would be individual to and provides an account identification of the credit card holder, being translatable into the owner's account number.

The machine-readable element 14, when scanned by machine 12, transmits the data obtained from scanning of the account identification element 14, over a communication link 16 (e.g., a telephone line), to a station reader controller 18. A computer at this location, which serves an entire group of scanners 10, verifies the account, if it is deemed a matter of policy that such verification at this point is economically feasible. It may indeed be true that such verification, at least at this point, can be dispensed with in the same way that verification of credit, at the point of purchase, is typically dispensed with if the amount being charged is below a specified sum, e.g., $50. Hereinafter, a procedure that can if desired be followed when an account is found not entitled to credit will be discussed in detail. For the moment, it will be assumed that the account has been properly verified, found valid, and entitled to credit.

In these circumstances, the computer at the station 18 transmits, by a telecommunications link or other suitable communications line 19, the data accumulated by the several scanners 10 to a central computer 20.

Other toll stations 22, similar to the station 18, are geographically removed from station 18 and from each other. They also transmit, to the central computer 20 of the toll road authority, data obtained from the scanners served thereby, over telecommunications links or other connecting lines 23.

At each station 18 or 22, local storage is provided as at 24, of the data received from the scanners 10 served by the station. This storage includes disc packs 26 and/or hard copy 28. The provision of local storage at each station 18 is optional, according to administrative determinations made by the toll road authority.

At the central computer 20, there is also provided means for storage of data, in the form of disc packs 27 and hard copy 29. This information can be accumulated and categorized by toll booth, hours, shifts, or by the day, and provides a data base for traffic studies and analysis.

At this point, it may be noted that a central computer 20 would exist at headquarters, or at any other location deemed suitable, of each officially established toll collection authority. For example, it is customary to establish a commission or other quasi-governmental authority, for administering a single toll highway system within a particular state. Accordingly, assuming the use of the FIG. 1 system on a national basis, there would be a central computer for each independent toll collection authority, whatever form that authority may take in a particular state or country.

This being so, it is important that the data received at the central computers of the several, independent toll collection authorities, be transmitted to a collection point established to serve the independently operating toll collection authorities, by receiving information from all of said authorities, separating such information according to the individual credit card companies that have extended credit customers using the toll facilities of the various collection authorities, and thereafter transmitting the data to the several credit card companies for billing to their customers.

To this end, the central data collection entity 30 receives the data via telecommunications links 31, from the central computers 20 of the various reporting toll road authorities. At the collection point 30, facilities for record storage are again provided, in the form of disc packs 32 and hard copy 34.

Since each computer 20 will be transmitting data that must ultimately be fed to various, individual credit card companies, a main frame computer is provided at the central data collection agency 30. This computer receives data from all the central computers 20, and classifies or separates this data according to the data to be transmitted to credit card company A, or B, or C, or D.

The data, when so separated, is transmitted to the computers of companies A, B, C, and D over telecommunications links 38, 40, 42, 44 respectively. These computers either constitute or feed computers of the billing authorities of companies A, B, C, and D, and bill the customers automatically, listing the toll charges along with other purchases made by the customers on the regular monthly statements sent to the customers. The billings 50 are sent to the customers' addresses designated at 52, and payments made as at 54 by the customers are returned by mail or by electronic credit as at 56 to the several credit card companies. The companies also are responsible, as shown at 57, for transmitting to the body of customers 52 the code elements 14.

The companies A, B, C, and D, comprising the credit grantors, are also responsible for disbursing to the several toll road authorities the amounts represented by tolls charged on credit through said authorities. The disbursements made by the credit companies are shown at 46, and are transmitted back to the several toll collection authorities as at 48, either by mail, or by electronic money transfer. Disbursements are also made, through the mail or electronic credits shown at 48, to the central data collection agency 30 for the services rendered by it to the credit card companies.

This constitutes the normal operation of the toll credit-extending and billing system. In some instances, however, it may be that a vehicle is bearing a sticker or account identification element 14, that is not entitled to credit. The detection of this situation can be made by a computer, located either at the station 18 or at the scanner itself, assuming, of course, that prompt detection has been found desirable as a matter of policy. It is more likely, however, that considering the expense of detecting and stopping "credit cheats" and the effect thereof on smooth traffic flow and smooth operation of the system, the vehicle may be allowed passage but the number may thereafter go on a so-called "bad list" of perhaps 1,000 numbers to facilitate locating and even stopping of the vehicle should re-use of the highway facility be attempted at a later date by its owner or operator.

Assuming that a vehicle known to be bearing a "bad number" is found to be entering the highway facility, this intelligence can be transmitted almost instantaneously to mechanisms for blocking passage of the vehicle and/or videotaping the vehicle's license number.

This portion of the system may, thus, include elevatable gates 58, one of which would be disposed at each scanning location in position to block the vehicle V whose account identification element is found to be on the "bad list". The mechanism for lowering the gate operates on a signal from the computer at station 18, or possibly at the location of the scanner 12, through lines 60.

There may also be provided a stop-and-go traffic signal 64, also connected to the computer at the station 18 or to an associated scanner 12, and activated through line 62 either to signal the vehicle that it may pass, or alternatively, show a red signal indicating that the vehicle is to stop and await a personal check of the situation made by an employee of the toll collection authority.

Videotape recorders are shown at 68, and are activated through lines 66 from the account-verifying computer. Assuming that the element 14 on a particular vehicle V has been found to be on the "bad list" and hence unworthy of credit, recorder 68 located in position to photograph the vehicle is activated to record a picture of the vehicle and in particular the license number thereof. Of course, any one or more of the traffic control devices 58, 64, 68 can be used at each traffic lane where a scanner 12 has been installed.

Figure 2:
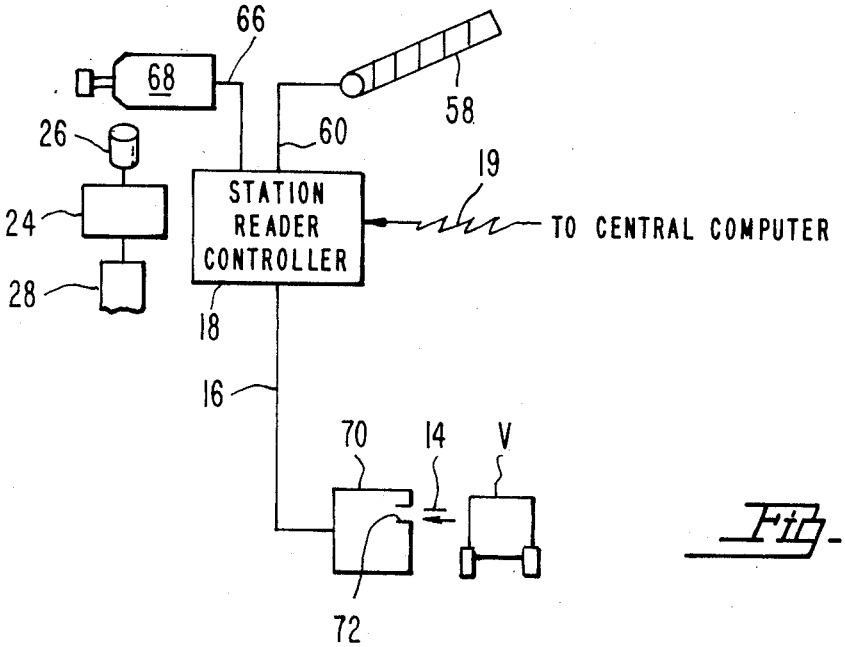
FIG. 2 is a fragmentary, schematic view showing a modification as used for parking areas.

In FIG. 2, the invention is shown as adapted to a parking lot or parking building. It is still possible, in such an instance, to use scanners 12 and elements 14 affixed to the vehicles. Alternatively, since in this instance traffic moves very slowly out of the parking lot or building, and indeed must come to a stop before leaving, it may be desired to use, instead of scanner 12, a machine 70 having slot 72 receiving the account identification element 14. In this instance the vehicle V comes to a stop beside the machine, and the driver positions the element 14 in the slot 72, and withdraws the element after it has been read by the machine. The data read by the machine is transmitted via line 16 to station 18, after which the full procedure hereinbefore described with reference to FIG. 1, is carried out.

In the instance of a parking lot or a parking building, it may be desired that gate 58 be operated on the passage of each and every vehicle. In this event, gate 58 might be normally maintained in a lowered position. Line 60 would connect the gate to the computer, and each time the computer indicates that the vehicle is entitled to credit, the gate would be signaled by the computer to lift to permit the passage of the vehicle. If the vehicle number is on the limited "bad list" requiring denial of credit, the gate remains lowered. Again, a videotape recorder 68 may or may not be used in combination with the gate. Normally, in the arrangement shown in FIG. 2, the recorder 68 would be operated only if credit is denied.

Of course, in the form of the invention shown in FIG. 1, it may be desired, for the purpose of safety and for the purpose of assuring proper control of traffic, to deliberately require that the vehicle V slow down as it approaches scanner 12. In this event, the toll authority may decide to require that a gate 58 be maintained, normally, in blocking position in each lane where a scanner 12 is installed, lifting only if verification of a valid bar code element 14, by reason of its absence from the numerically limited list of "bad numbers", is made.

Existing toll booths can be readily modified by having the scanner mounted on or adjacent the same, thus permitting the invention to be incorporated in existing traffic lanes, at toll plazas already in use.

It may also be noted that there are various methods of collecting tolls. On some toll roads, at periodic intervals predetermined amounts are required. In this event, the computer mechanism need make no calculation of the toll, since it is established in advance and is automatically charged each time a vehicle passes the scanner. This will be true, for example, at tunnels and bridges, in most instances.

At other toll collection locations, however, as for example the toll booths at the end of a toll road having a plurality of exits, a separate calculation must be made for each vehicle passing the scanner. This can be readily dealt with by having a scanner at each location at which vehicles enter the highway. Such a scanner would record the time of entry of the vehicle onto the highway, and the location. The data so obtained would be transmitted to the computer at station 18. Thereafter, when the vehicle leaves the highway, as it passes scanner 12 located at the exit selected by the driver, that scanner will take note of the exit and transmit the data relating to the exit of the vehicle, to the same computer which received the information as to the vehicle's entry upon the highway. The computer, as for example at station 18, takes note of the data relating to the vehicle's entry and exit, and calculates the toll, transmitting the calculation as part of the data fed by the station 18 to the central computer 20.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. The method of extending credit to, and thereafter billing, individual customers of a credit grantor for fees incurred by operation of a vehicle indentified with the customer past any one of a plurality of given scanning locations, that comprises the steps of:

(a) providing each customer with a machine-readable bar code element that is issued by the credit grantor, bears an account identification, and is adapted to be attached to an exteriorly visible surface of the customer's vehicle;

(b) machine-reading said element while the vehicle is in movement past said location;

(c) transmitting the machine-read data from said locations through a computer system common to all of said locations, to a central billing authority of the credit grantor; and (d) transferring said data, at the location of the billing authority, to billings addressed to the customers in the amounts chargeable for operation of their vehicles past said point.

2. The credit-extending and billing method of claim 1 that includes forming said scanning locations into separate groups each of which is served by a computer station that comprises part of said computer system; collecting at said station the machine-read data obtained at the several scanning locations served by said station; and transmitting the data so collected from said station through the computer system to the billing authority of the credit grantor issuing the element from which the data has been obtained.

3. The credit-extending and billing method of claim 2 that includes the further step of transmitting the data collected by the computer station to a central computer established to receive similar data from a plurality of similar computer stations, and thereafter transmitting the data received by the central computer for use in billing the customers from whose machine-readable elements said data has been obtained.

4. The credit-extending and billing method of claim 3 wherein the step of transmitting data from the central computer for billing to the customers includes directing said data from the central computer to a central data collection point; separating the collected data at said point into distinct data subgroupings each of which contains only data obtained from the machine-readable elements issued by a single credit grantor, whereby said subgroupings will correspond, respectively, to distinct credit grantors; and then transmitting to the billing authorities of the several credit grantors the respective data subgroupings representing the data collected from the elements issued thereby.

5. The credit-extending and billing method of claim 4, further including storing the data machine-read from the elements of each group of scanning locations in computer disc packs and hard copy at the several computer stations respectively serving said groups.

6. The credit-extending and billing method of claim 4, further including storing in disc packs and hard copy, at the central computer, the data transmitted thereto by the several computer stations.

7. The credit-extending and billing method of claim 4, further including storing, at the central data collection point, the data transmitted thereto by the central computer.

8. The credit-extending and billing method of claim 4 further including storing, in disc packs and hard copy, the data received at the several computer stations, the central computer, and the central collection point.

9. The credit-extending and billing method of claim 1, that includes the further step of applying a bar code to said elements, and mounting the elements on a vehicle in position to be machine-read at each of the scanning locations as the vehicle passes the location.

10. A credit-extending and billing method as in claim 1 that includes the step of checking, at the computer station, the account identification of the customer presenting a machine-readable element at a scanning location served by said station, against a limited list of known credit violators, and thereafter controlling a gate at said location to block passage of the vehicle if the extension of credit is disapproved.

11. A credit-extending and billing method as in claim 1 further including the step of verifying, at the computer station, the extendability of credit to the customer presenting a machine-readable element at a scanning location served by said station, by checking the customer's number against a list of known credit violators, and thereafter having the station computer control operation of a video recorder to provide a visual taped record of identifying information as to each vehicle displaying an element determined by the station computer as not being entitled to credit.

12. A credit-type system for the collecting of tolls and like fees required for vehicle use on toll roads, parking areas, and the like, comprising:

(a) a card-like element on which is imprinted a bar code containing in coded form account identification indicia individual to a credit customer's account, said element being secured to an exteriorly visible surface of a vehicle;

(b) a machine for reading said code, said machine being mounted at a scanning location past which the vehicle is required to be driven and being adapted to read the code while the vehicle is in motion;

(c) a computer network having input and output ends, said network adapted to receive as input the date read from the element by said machine; and (d) a billing authority receiving said data from the output end of said network for billing the customer account corresponding to said account identifying indicia.

13. A credit-type toll collection system as in claim 12 wherein said network includes a computer station serving a selected grouping of said machines and constituting the input end of the network, said station being adapted to receive said data from the several machines of the associated group for optional comparison of the data against a list of credit violators whereby to permit spot approval of the extension of credit to the identified customer account prior to passage of the vehicle past the scanning location.

14. A credit-type toll collection system as in claim 13 further comprising means responding to disapproval of credit for physically blocking departure of a vehicle from the scanning location.

15. A credit-type toll collection system as in claim 13 further comprising means responding to disapproval of credit for videotaping a record of a vehicle departing from the scanning location.

16. A credit-type toll collection system as in claim 13 wherein said network comprises a central computer adapted to receive data from a plurality of said computer stations and adapted to transmit the data so received for billing to the identified accounts.

17. A credit-type toll collection system as in claim 16 wherein said network, at its output end, comprises a central data collection computer adapted to receive data from the central computer and transmit the same for billing to the identified accounts.

18. A credit-type toll collection system as in claim 17 wherein the central collection computer is adapted to segregate the data received thereby into groupings according to distinct grantors of credit as represented by machine-readable elements issued by the several grantors, said control collection computer being adapted to transmit the grouped data to the respective credit grantors identified with the elements from which said data has been obtained.

19. The method of charging, billing and collecting tolls that are incurred by participating customers of credit grantors by reason of the operation of the customers' vehicles over toll highways, bridges, and like toll facilities, that comprises the steps of:

(a) providing each participating customer with a bar code element that is attachable to an exteriorly visible surface of the customer's vehicle and that is coded to provide at least that customer's account number;

(b) providing machines at selected locations passed by vehicles operated upon the facility, that will read the bar codes of passing vehicles while they are in movement, and that will feed to a station computer the data coded on said element together with supplementary data needed to establish the amount of the toll and to provide records relating thereto usable advantageously by the customer, the credit grantor which issued the bar code element, and the authority controlling the facility;

(c) transmitting said data to a central computer of said authority adapted to receive the data from the station computer and other station computers like it that are under the control of said authority and that are in use upon the facility;

(d) transmitting said data to a main frame computer adapted to receive the data from the central computer of said authority and from the central computers of other toll facility control authorities; and (e) at the main frame computer, separating said data according to the individual credit grantors that have issued the bar code elements to their respective customers, and transmitting to each credit grantor the data respecting the use of the toll facilities of the several control authorities by the customers of that credit grantor.

* * * * *